US006656544B1

(12) United States Patent
Ishikawa et al.

(10) Patent No.: US 6,656,544 B1
(45) Date of Patent: Dec. 2, 2003

(54) INK-JET RECORDING MEDIUM

(75) Inventors: Takayuki Ishikawa, Kanagawa-ken (JP); Nobuhiro Kubota, Shizuoka-ken (JP); Shigeki Asai, Shizuoka-ken (JP); Minoru Tsuchida, Shizuoka-ken (JP); Kiyoshi Iwamoto, Shizuoka-ken (JP); Jun Sugiyama, Nagano-ken (JP); Hiroyuki Onishi, Nagano-ken (JP); Yukari Ishikawa, Kanagawa-ken (JP)

(73) Assignee: Tomoegawa Paper Co., LTD, Tokyo (JP)

( * ) Notice: Subject to any disclaimer, the term of this patent is extended or adjusted under 35 U.S.C. 154(b) by 50 days.

(21) Appl. No.: 09/868,613

(22) PCT Filed: Oct. 26, 2000

(86) PCT No.: PCT/JP00/07504

§ 371 (c)(1),
(2), (4) Date: Jun. 26, 2001

(87) PCT Pub. No.: WO01/30583

PCT Pub. Date: May 3, 2001

(30) Foreign Application Priority Data

Oct. 26, 1999 (JP) ..... 11-303847

(51) Int. Cl.[7] ..... B41M 5/00
(52) U.S. Cl. ..... 428/32.1; 428/500; 428/522
(58) Field of Search ..... 428/195, 500, 428/32.1, 523

(56) References Cited

U.S. PATENT DOCUMENTS

| | | | | | |
|---|---|---|---|---|---|
| 4,741,969 | A | * | 5/1988 | Hayama et al. | 428/514 |
| 5,731,263 | A | * | 3/1998 | Totsuka et al. | 503/227 |
| 5,942,329 | A | * | 8/1999 | Nakayama et al. | 428/423.1 |
| 6,089,704 | A | * | 7/2000 | Burns et al. | 347/105 |
| 6,207,613 | B1 | * | 3/2001 | Torii et al. | 503/201 |
| 6,214,458 | B1 | * | 4/2001 | Kobayashi et al. | 428/332 |
| 6,548,150 | B1 | * | 4/2003 | Ishikawa et al. | 428/195 |

OTHER PUBLICATIONS

Patent Abstract of Japan, 10–264511 Oct. 6, 1998.
Patent Abstract of Japan, 11–138980 May 25, 1999.
Patent Abstract of Japan, 09–300810 Nov. 25, 1997.

* cited by examiner

*Primary Examiner*—B. Hamilton Hess
*Assistant Examiner*—B. Shewareged
(74) *Attorney, Agent, or Firm*—Arent Fox Kintner Plotkin & Kahn, PLLC

(57) ABSTRACT

A recording medium for ink jet printers having superior effects in preventing recorded image deterioration such as lowering of image clarity, decrease in density, change in color tone, etc., under high temperature and high humidity, is provided. An ink receiving layer is formed on a base material by coating acrylic copolymer containing at least (meth)acrylate having a solubility parameter (δ) of 15.0 to 23.0 $MPa^{1/2}$ as a copolymerizing component, and thereby a recording medium for ink jet printers is produced.

8 Claims, No Drawings

INK-JET RECORDING MEDIUM

TECHNICAL FIELD

The present invention relates to recording media, and specifically, relates to recording media for ink jet printers, in which superior effects can be exhibited in the storage of recorded images, in particular, in the prevention of deterioration phenomena in recorded images such as lowering of image clarity, decrease in density, and change in color tone, under high temperature and high humidity.

BACKGROUND ART

The use of ink jet printers is further increasing in recent years because they have characteristics such as vividness of recorded images, quiet operation, ease of coloring, and the like. In order to prevent the nozzle from being blocked due to drying of ink, an ink which is difficult to dry must be used in the ink jet printer. As ink having this property, water-soluble ink which is dissolved or dispersed with binder, dye, solvent, additives, or the like, in water, is generally employed. However, a letter or an image formed on the recording medium by using the water-soluble ink is easily affected by storage conditions for recorded images (temperature, humidity, etc.), and lowering of image clarity, decrease in density, and change in color tone are more easily caused than in printed matter using pigment-type inks or in silver halide photographs.

In recent years, as ink jet printers become less expensive and high vividness and colorfulness of printed images is anticipated, the requirements for storage of recorded images, or the like, are gradually becoming severe. Therefore, completely preventing deterioration of recorded images, which is caused by these image storage conditions, is an essential goal for recording media for ink jet printers.

In view of the present state, prevention of deterioration in recorded images caused by storage conditions of recording media for ink jet printers is being researched. Specifically, many methods in which deterioration of recorded images caused by storage conditions is prevented by adding various mordants to an ink receiving layer, have been proposed. However, the effects obtained by adding these mordants are insufficient, and moreover, a deleterious influence which lowers light resistance of images and which is larger than the effect is caused. Thus, although there is fear that the deleterious influences such as lowering image clarity which is larger than the effect of preventing deterioration of recorded images caused by the storage conditions is caused by adding strong mordants, etc., most of the approaches at present are in research with respect to additives, and there is little research with respect to resin compositions having effects of preventing deterioration of recorded images.

Furthermore, in general recording media for ink jet printers, although research with respect to prevention of deterioration of recorded images under indoor environments has been carried out, research under high temperature and high humidity in consideration of light resistance has not yet been sufficiently carried out, and a recording medium having a satisfactory effect for preventing deterioration of recorded images has not yet been obtained. Therefore, it is an object of the present invention to provide a recording medium for ink jet printers, in which superior effects can be obtained in storage of recorded images, and in particular, in the prevention of deterioration of recorded images, such as lowering of image clarity, decrease in density, and change in color tone, under high temperature and high humidity.

DISCLOSURE OF INVENTION

The present inventors have conducted various research with regard to resin compounds for use in an ink receiving layer, and have found that the deterioration of recorded images, such as lowering of image clarity, decrease in density, and change in color tone, under high temperature and high humidity, are very effectively prevented by using a water soluble acrylic type copolymer synthesized and prepared under specific conditions in the ink receiving layer, and the present invention has thereby been attained.

That is, a recording medium for ink jet printers according to the present invention is characterized in that an ink receiving layer is provided on a base material, and the ink receiving layer contains an acrylic type copolymer in which at least (meth)acrylate having a solubility parameter (δ) of 15.0 to 23.0 $MPa^{1/2}$ is a copolymerizing component.

In addition, it is preferable that the acrylic type copolymer used in an ink receiving layer of a recording medium for ink jet printers according to the present invention be copolymerized (meth)acrylate in which an ester group is a cycloalkyl group. Furthermore, it is more preferable that the acrylic type copolymer be a copolymer consisting of at least four copolymerizing components, (a) component: (meth) acrylate having a solubility parameter (δ) of 15.0 to 23.0 $MPa^{1/2}$, (b) component: dialkylaminoalkyl (meth)acrylate, (c) component: acrylamide, and (d) component: alkoxy polyethylene glycol (meth)acrylate, and it is most preferable that the acrylic type copolymer be a copolymer consisting of five copolymerizing components in which (e) component: 2-hydroxyalkyl (meth)acrylate is further added.

In the case in which the above ink receiving layer is provided as a multilayer, an ink receiving layer provided on the surface side is given a glossiness in which the specular gloss is 10 or more and is formed as a glossiness adjusting layer. In this way, according to a recording medium for ink jet printers of the present invention which contains the above acrylic type copolymer in the glossiness adjusting layer, the glossiness is improved in comparison with conventional media, and a water repellent effect is obtained without decreasing the absorbability of the ink for ink jet printing. Therefore, the medium does not immediately absorb water even if the medium is wetted by water, and an effect for improving the water resistance of the recording medium can also be obtained.

In the following, preferable embodiments according to the present invention will be explained in detail.

A recording medium for ink jet printers of the present invention is a laminated structure in which an ink receiving layer is provided on a base material by a laminating means such as coating method, and the ink receiving layer may consist of two or more layers. The surfacemost layer in the ink receiving layer may be an ink receiving layer in which the specular gloss is adjusted to a desired glossiness, that is, a glossiness adjusting layer. The glossiness of this layer can be optionally adjusted from non-gloss to high-gloss by a coating method, drying method, composition, etc. In the case in which the ink receiving layer consists of multiple layers, an acrylic type copolymer in the present invention may be contained in at least one ink receiving layer.

As an acrylic type copolymer used in an ink receiving layer in a recording medium for ink jet printers of the present invention, it is necessary to contain a copolymer in which (meth)acrylate having a solubility parameter (δ) of 15.0 to 23.0 $MPa^{1/2}$ is a copolymerizing component. In addition, it is preferable that a water-soluble acrylic copolymer consist of (a) component: (meth)acrylate having a solubility parameter (δ) of 15.0 to 23.0 $MPa^{1/2}$ and at least one copolymerizing component chosen from (b) component: dialkylaminoalkyl (meth)acrylate, (c) component: acrylamide, (d) component: alkoxy polyethylene glycol (meth)acrylate, and (e) component: 2-hydroxyalkyl (meth)acrylate. In the following, materials which constitute a recording medium for ink jet printers of the present invention and a process for producing the medium will be explained.

A. Acrylic Type Copolymer (1) Copolymerizing Component

The present invention is characterized in that an effect for preventing deterioration of recorded images under high temperature and high humidity is exercised by using (a) component: (meth)acrylate having a solubility parameter (δ) of 15.0 to 23.0 $MPa^{1/2}$ as an essential component. The (a) component in the present invention is a compound in which the solubility parameter (δ) which makes the heat of vaporization described in "POLYMER HANDBOOK, FOURTH EDITION VII/675" to be a standard is 15.0 to 23.0 $MPa^{1/2}$.

As a specific example of the component, components having a substituent at an ester position, such as an ethyl group, methyl group, propyl group, butyl group, hexyl group, octyl group, cyclohexyl group, cyclopentyl group, cyclooctyl group, etc., may be mentioned. Among these, the cycloalkyl group is preferred.

The (b) component: dialkylaminoalkyl (meth)acrylate is a copolymerizing component to obtain water solubility (water resistance) of synthetic acrylic copolymer, and miscibility and stability between the copolymer and pigment. The (b) component is not particularly limited. Specifically, as a (b) component, dimethylaminomethyl (meth)acrylate, diethylaminomethyl (meth)acrylate, dimethylaminoethyl (meth) acrylate, diethylaminoethyl (meth)acrylate, dipropylaminomethyl (meth)acrylate, dipropylaminoethyl (meth) acrylate, etc., may be mentioned. Among these compounds, dimethylaminoethyl (meth)acrylate and diethylaminoethyl (meth)acrylate are most preferable since the above properties are superior.

Furthermore, it is desirable that the (c) component: acrylamide be used together to further improve the miscibility with pigment.

The (d) component: alkoxy polyethylene glycol (meth) acrylate which seems to give water solubility and transparency (that is, clarity of printing images) to the acrylic copolymer in the present invention is not particularly limited. As a (d) component, dimethoxy polyethylene glycol (meth)acrylate, diethoxy polyethylene glycol (meth) acrylate, dipropoxy polyethylene glycol (meth)acrylate, etc., can be mentioned.

It is preferable that these compounds have molecular weights of 200 to 2000. When the molecular weight of the polyethylene glycol portion exceeds 2000, the synthetic acrylic copolymer becomes waxy by deteriorating water solubility, and the clarity of the image is thereby affected. In contrast, when the molecular weight is below 500, the strength of the copolymer is weakened and there is a problem in that layer strength is lowered. Therefore, it is further preferable that the molecular weight be 500 to 1500, and as a (d) component, in particular, dimethoxy polyethylene glycol #1000 (meth)acrylate, diethoxy polyethylene glycol #1000 (meth)acrylate, dipropoxy polyethylene glycol #1000 (meth)acrylate are preferred.

The (e) component: 2-hydroxyalkyl (meth)acrylate which seems to similarly give transparency (image clarity) to the copolymer is not particularly limited, and as the (e) component, 2-hydroxymethyl (meth)acrylate, 2-hydroxyethyl (meth)acrylate, 2-hydroxypropyl (meth) acrylate, etc., may be mentioned. Among these, 2-hydroxyethyl (meth)acrylate is most preferred from the viewpoint of water solubility and transparency (that is, image clarity).

It is preferable that an acrylic copolymer in the present invention comprise at least four copolymerizing components of (a) component: (meth)acrylate having a solubility parameter (δ) of 15.0 to 23.0 $MPa^{1/2}$, (b) component: dialkylaminoalkyl (meth)acrylate, (c) component: acrylamide, and (d) component: alkoxy polyethylene glycol (meth)acrylate. In this case, a copolymerization ratio (weight ratio) of the (a) component is preferably 5 to 25% by weight, more preferably 7 to 22% by weight, and most preferably 10 to 20% by weight in order to sufficiently achieved an object of the present invention and to ensure moderate hydrophilic-lipophilic balance (HLB) of the synthetic acrylic copolymer.

It is preferable that a copolymerization ratio (weight ratio) of the (b) component be as small as possible, and the ratio is preferably 30 to 60% by weight, more preferably 35 to 50% by weight, and most preferably 45 to 48% by weight in consideration of water-solubility of the above copolymer, improved effect of miscibility of pigment, etc. Here, when the ratio exceeds 60% by weight, there is a problem in that the light resistance of images is deteriorated. A copolymerization ratio (weight ratio) of the (c) component is preferably 2 to 7% by weight, more preferably 3 to 5% by weight, and most preferably 3.5 to 4.5% by weight. Here, when the ratio exceeds 7% by weight, there is a problem in that water resistance is deteriorated. A copolymerization ratio (weight ratio) of the (d) component is preferably 5 to 65% by weight, more preferably 7 to 60% by weight, and most preferably 45 to 55% by weight. When the ratio is below 5% by weight, stability and clarity of the coating material are not obtained. In contrast, when the ratio exceeds 65% by weight, there is a problem in that water resistance is deteriorated.

In addition, it is preferable that an acrylic copolymer in the present invention comprise five copolymerizing components which adds the (e) component: 2-hydroxyalkyl (meth) acrylate to the above four components, and further superior stability of coating material and further superior water resistance of an ink receiving layer can be obtained by comprising these five components. In this case, a copolymerization ratio (weight ratio) of (e) component is preferably 0 to 55% by weight, more preferably 5 to 45% by weight, and most preferably 20 to 40% by weight. When the ratio exceeds 55% by weight, there is a problem in that ink absorbability is deteriorated.

Furthermore, a polymerization inhibitor is generally added to these copolymerizing components in order to prevent polymerizing during storage. In the copolymerizing components of an acrylic copolymer in a recording medium for ink jet printers of the present invention, the addition amount of the polymerization inhibitor is preferably 500 ppm or less, more preferably 300 ppm or less, and most preferably 200 ppm or less.

(2) Polymerization Method

In the present invention, the above-described copolymerizing components are dissolved in a mixed solvent of water and alcohol and are synthesized in accordance with a reaction condition described in the following, and solid matter is extracted from reaction products by concentration, etc., and therefore an acrylic copolymer is obtained. In the following, a polymerizing apparatus, a synthesizing condition, etc., in the case of synthesis of the acrylic copolymer in the present invention, will be explained.

<Polymerizing Apparatus>

As a resin component in a recording medium for ink jet printers of the present invention, a water-soluble acrylic copolymer synthesized by radical polymerization using a general water-soluble polymerization solvent can be employed. Therefore, as an apparatus for polymerizing the resin component, a stirring apparatus in the reaction system, an adjusting apparatus for the reaction temperature, a cooling and reflux apparatus, a dropping apparatus for carrying out polymerization reactions in a two solution-system, etc., may be mentioned, and in addition, any general synthesizing apparatus for water soluble resin can be employed.

<Polymerization Initiator>

As a polymerization initiator for synthesizing the acrylic copolymer of the present invention, general well-known radical polymerization initiators for water-soluble acrylic resin can be employed, and specifically, two types of azo-type polymerization initiator and peroxide-type polymerization initiator can be mentioned. As an azo-type polymerization initiator, 2,2'-azobis-isobutyronitrile (AIBN), 2,2'-azobis-2-methyl butyronitrile (AMBN), 1,1'-azobis-1-cyclohexane carbonitrile (ACHN), dimethyl-2,2'-azobis isobutyrate (MAIB), 2,2'-azobis-(2-amidinopropane)-2-hydrochloride (ABAH), etc., can be employed. Additionally, as a peroxide-type polymerization initiator, benzoyl peroxide, decanoyl peroxide, acetyl peroxide, t-butylperoxy isobutylate, octanoyl peroxide, succinic acid peroxide, etc., can be employed. The 10 hour half-life temperature of the these initiators is preferably 60 to 90° C., and is more preferably 65 to 80° C. in consideration of polymerization efficiency, polymerization stability, or the like.

When a polymerization initiator in which the half-life temperature is too low is used, reaction time is increased with lowering reaction temperature, and therefore the molecular weight of polymerized water soluble resin is excessively increased, and solubility of the resin is deteriorated and ink absorbability and image clarity of the resin are thereby inferior. In contrast, when the half-life temperature is too high, the reaction temperature is excessively increased and there are problems in that runaway of the reaction and production of impurities occur.

<Polymerization Solvent>

As a solvent for polymerizing the acrylic copolymer in the present invention, water, alcohol, water-soluble ketone, solvent mixtures thereof, etc., may be mentioned in consideration of solubility of the copolymerization component. In particular, among these, a solvent having a boiling point of 75 to 100° C. is preferred in view of polymerization reaction temperature, molecular weight of polymerized resin, polymerization reaction time, or the like. When a solvent in which the boiling point temperature is too low is used, reaction temperature is lowered, reaction time is increased, and therefore the molecular weight of polymerized water soluble resin is excessively increased, and solubility of the resin is deteriorated and ink absorbability and image clarity of the resin are thereby inferior. In contrast, when the boiling point temperature is too high, the reaction temperature is excessively increased and there are problems in that runaway of the reaction and production of impurities occur. This is the same as the selection reasons of the polymerization initiator.

Therefore, as a polymerization solvent, a solvent mixture of water and alcohol, in particular, a solvent mixture of water and isopropanol, is preferred and the mixing ratio of water and alcohol by weight is preferably 4/1 to 1/1, more preferably 2/1 to 1/1, and most preferably 2/1.

Furthermore, the solvent can be employed to remove residual copolymerization components, etc., and for purifying.

<Polymerization Reaction Temperature>

Polymerization temperature of the acrylic copolymer in the present invention is appropriately selected by reaction activity of the copolymerization component, solvent used in synthesizing, type of polymerization initiator, molecular weight of desired resin, or the like. When the polymerization temperature is too low, efficiency of the polymerization reaction is lowered and the molecular weight of the copolymer is excessively increased. In contrast, when the temperature is too high, it is difficult to ensure safety during operations and to prevent impurities from being produced, and therefore the temperature is preferably 60 to 100° C., and more preferably 80 to 90° C.

<Molecular Weight>

When the weight average molecular weight of acrylic copolymer in the present invention is less than several thousand, an ink receiving layer using obtained copolymer cannot yield sufficient film strength. In contrast, when the weight average molecular weight is greater than 100,000, solubility of copolymer, ink absorbability of an ink receiving layer used in the copolymer, etc., are deteriorated, and therefore the weight average molecular weight is preferably several thousand to 100,000, more preferably 10,000 to 50,000, and most preferably 10,000 to 20,000.

B. Recording Medium for Ink Jet Printers

The acrylic copolymer synthesized by a method as described above is dissolved in a water-soluble solvent, and a binder resin solution is thereby obtained at desired solid concentration. Subsequently, water soluble resin, pigment, and other additives which are generally used in the ink receiving layer are also dissolved or dispersed in the binder resin solution as necessary, and thereby a coating material for an ink receiving layer is prepared. A solvent in this preparation may be any water-soluble solvent and is not particularly limited. The solvent is employed by appropriately selecting the solvent polarity in consideration of solubility of the acrylic copolymer, stabilities of prepared acrylic copolymer and coating material using the acrylic copolymer, ink permeability of a forming layer, image clarity, or the like. Among these, a solvent mixture of water and alcohol is preferred, and as an alcohol, isopropanol is most preferred. In addition, the mixing ratio of the solvent by weight is preferably 4/1 to 1/1, more preferably 2/1 to 1/1, and most preferably 1/1.

In the present invention, the solid concentration of the coating material for the ink receiving layer in the acrylic copolymer is preferably 20 to 50%, more preferably 30 to 50%, and most preferably 30 to 40% in consideration of ink receiving layer strength, stability of mixing with pigment, image properties such as ink permeability, image clarity, and the like.

As a water soluble resin which can be employed as a binder with an acrylic copolymer in an ink receiving layer, polyvinyl alcohol, carboxy modified polyvinyl alcohol, vinyl acetate, oxidized starch, etherified starch, casein, gelatin, soybean protein; cellulosic derivatives such as carboxymethyl cellulose, hydroxyethyl cellulose, or the like; conjugate diene type copolymer latex such as maleic anhydride resin, styrene-butadiene type copolymer, methyl methacrylate-butadiene copolymer, or the like; acrylic type polymer latex such as (meth)acrylic acid ester polymer, (meth)acrylic acid ester copolymer, or the like; vinylic type polymer latex such as ethylene-vinylacetate copolymer, or the like; functional group modified polymer latex consisting of monomers including functional groups such as a carboxy group, or the like, of all types of these polymers; water-soluble adhesive comprising thermosetting synthetic resin such as melamine resin, urea resin, or the like; synthetic resin type adhesive such as polymethyl methacrylate, polyurethane resin, unsaturated polyester resin, vinylchloride-vinylacetate copolymer, polyvinyl butyral, alkyd resin, or the like, can be mentioned. These can be employed alone or in combination.

As a pigment which can be appropriately mixed in the ink receiving layer, conventional filling materials and organic or inorganic pigments such as silica, alumina, clay, calcium carbonate, etc., may be employed, and the pigment is not particularly limited. As a result of the research of the present inventors, it is preferable that spherical silica or nonspherical silica be employed in the ink receiving layer, and it is most preferable that colloidal silica or colloidal alumina be employed as a pigment in the case in which an ink receiving layer at the surface side is formed as a glossiness adjusting layer.

In addition, according to a preferable aspect of the present invention, various additives can be further contained in the ink receiving layer in order to further improve properties of the recording medium for ink jet printers. As a preferable example of such additive, dye fixer, antioxidant, ultraviolet absorbing agent, fluorescent whitening agent, water proof agent, anti-static agent, etc., can be mentioned.

Next, an ink receiving layer is formed by applying the above coating material on a sheet-like substrate such as paper, plastic film, etc., and drying it, and thereby a recording medium for ink jet printers in which image properties, light resistance, etc., are superior, can be produced. Here, the ink receiving layer may be formed by providing with two or more layers as described above. As a form of a surface, a finished surface such as a surface in which glossiness is optionally controlled at a specular glossiness of 10 or more, a surface finished to a matte style, a surface having a special shape subjected to an embossing, or the like, is mentioned. In an ink receiving layer containing an acrylic copolymer in the present invention, a mixing ratio of binder and pigment is preferably 5:95 to 50:50, and more preferably 10:90 to 35:65. In the case in which the ink receiving layer is also a glossiness adjusting layer, the mixing ratio is preferably 5:95 to 30:70, and more preferably 5:95 to 20:80.

BEST MODE FOR CARRYING OUT THE INVENTION

Next, effects of the present invention are further clarified by Examples and Comparative Examples based on the present invention.

1. Preparation of Acrylic Copolymer of Example or Comparative Example

Acrylic copolymers 1 to 8 consisting of compositions shown in Table 1 were prepared in accordance with the following solution polymerization method. Solubility parameter (δ) of (a) component was 18.5 $MPa^{1/2}$.

(1) A water-soluble solvent (polymerization solvent) was added in a four neck flask having a capacity of 1 liter, and a stirring device, a thermometer, a cooling tube, and a drop bottle were set thereto, and then the flask was heated to a reaction temperature.

(2) Copolymerization components shown in Table 1 were mixed with an initiator (5% by weight to the copolymerization components) in the same solvent as in (1) and were dissolved.

(3) The solution in (2) was continuously dropped in the flask stirred in (1) for 2 hours, and subsequently, reaction was carried out by stirring and heating for 4 hours.

(4) After the reaction was finished, the reaction mixture was distilled under reduced pressure and acrylic copolymer solid was obtained by removing the polymerization solvent.

(5) The acrylic copolymer obtained in (4) was dissolved by a solvent for dissolution in Table 1, and a resin solution of solid concentration shown in Table 1 was prepared as a binder resin in a recording medium for ink jet printers.

Completion of the copolymerization reaction was confirmed by comparison of intensities of substituent peaks using $^1H$ Fourier transform nuclear magnetic resonance spectrum and by disappearance of absorption near 1700 $cm^{-1}$ due to a double bond using a Fourier transform infrared absorption spectrum. Then, for example, cyclohexyl methacrylate was identified by absorption of a finger-print region at wavelengths longer than 1500 $cm^{-1}$, dimethylaminoethyl methacrylate was identified by absorptions at near 1050, 1450 and 2800 $cm^{-1}$, methoxy polyethylene glycol methacrylate was identified by absorption of a finger-print region at wavelengths longer than 1500 $cm^{-1}$, and 2-hydroxyethyl methacrylate was identified by absorptions at 700 and 3600 $cm^{-1}$. Subsequently, the copolymerizing component ratio in Table 1, that is, a copolymerization ratio, was calculated by comparison of intensities of these peaks. Additionally, weight average molecular weight was determined by a gel permeation chromatography (GPC) using THF as an eluent.

TABLE 1

| | | Copolymer 1 | Copolymer 2 | Copolymer 3 | Copolymer 4 | Copolymer 5 | Copolymer 6 | Copolymer 7 | Copolymer 8 |
|---|---|---|---|---|---|---|---|---|---|
| Copolymer Component (%) | (a) Cyclohexyl methacrylate | 7.5 | 7.5 | 15.0 | 20.0 | 10.4 | — | — | — |
| | (b) Dimethylaminoethyl methacrylate | 44.3 | 30.0 | 59.5 | 35.4 | 50.0 | 80.0 | 100.0 | — |
| | (c) Acrylamide | 3.8 | 13.8 | 4.1 | 4.6 | 3.5 | 20.0 | — | 100.0 |
| | (d) Methoxyethyleneglycol #1000 methacrylate | 22.5 | 26.8 | 9.6 | 40.0 | 25.1 | — | — | — |
| | (e) 2-hydroxyethyl methacrylate | 21.9 | 21.9 | 11.8 | — | 11.0 | — | — | — |
| Polymerization initiator | | AIBN | AIBN | AIBN | AIBN | AIBN | AIBN | AIBN | AIBN |
| Ratio of solvent for polymerizing (water/isopropanol) | | 1/1 | 2/1 | 3/1 | 2/1 | 2/1 | 2/1 | 2/1 | 2/1 |
| Reaction temperature (° C.) | | 80 | 80 | 90 | 80 | 100 | 80 | 80 | 80 |
| Molecular weight | | 15000 | 10000 | 15000 | 15000 | 20000 | 15000 | 15000 | 15000 |
| Ratio of solvent for dissolving (water/isopropanol) | | 1/1 | 1/1 | 2/1 | 3/1 | 4/1 | 1/1 | 1/1 | 1/1 |
| Solid concentration (%) | | 35 | 40 | 35 | 40 | 35 | 35 | 35 | 35 |

2. Production of Recording Medium for Ink Jet Printers for Evaluation

In each recording medium for ink jet printers for the Examples and each for the Comparative Examples using the acrylic copolymer, wood-free paper having a basic weight of 90.0 g/m$^2$ was employed as a base material. A coating material having the following composition was coated on one surface of the base material and was dried, and a first ink receiving layer was provided. Then, a second ink receiving layer, that is, a glossiness adjusting layer, was provided on the first ink receiving layer, in the same manner as for the first ink receiving layer, except that a calender processing was carried out on the surface thereof. The coating volumes of both receiving layer and were 10.0 g/m$^2$.

EXAMPLES 1 TO 5 AND COMPARATIVE EXAMPLES 1 TO 3

Coating Material for First Ink Receiving Layer

Binder Resin

- Acrylic copolymer solution shown in Table 1, 140 parts by weight
- 10% solution of completely saponified polyvinyl alcohol (trade name: Kuraray-Poval PVA-117, produced by Kuraray Co., Ltd.), 500 parts by weight Pigment

- 20% solution of silica gel (trade name: Mizukasil P78D, produced by Mizusawa Industrial Chemicals Ltd.), 450 parts by weight Additive

- Cationic dye fixing agent (trade name: HP-134A, produced by Senka Co., Ltd., solid concentration 30%), 35 parts by weight Coating Material for Glossiness Adjusting Layer Binder Resin

- 10% solution of maleic acid modified polyvinyl alcohol (trade name: Gohsenal T-330, produced by The Nippon Synthetic Chemical Industry Co., Ltd.), 50 parts by weight Pigment

- Colloidal silica gel (trade name: Snowtex UP, produced by Nissan Chemical Industries, Ltd., solid concentration 20%), 225 parts by weight

EXAMPLES 6 TO 10 AND COMPARATIVE EXAMPLES 4 TO 6

Coating Material for First Ink Receiving Layer

Binder Resin

- Polyvinylacetal resin (trade name: Eslec KW-23, produced by Sekisui Chemical Co., Ltd., solid concentration 20%), 125 parts by weight
- Ethylene-vinyl acetate emulsion (trade name: Panflex OM-5500, produced by Kuraray Co., Ltd., solid concentration 55%), 45 parts by weight Pigment

- 20% dispersed aqueous solution of silica gel (trade name: Fine Seal X-60, produced by Tokuyama Co., Ltd.), 250 parts by weight Additive

- Cationic dye fixing agent (trade name: Sumirese resin 1001, produced by Sumitomo Chemical Co., Ltd., solid concentration 30%), 35 parts by weight Coating Material for Glossiness Adjusting Layer Binder resin

- Acrylic copolymer solution shown in Table 1, 14 parts by weight

Pigment

- Colloidal silica gel (trade name: Snowtex UP, produced by Nissan Chemical Industries, Ltd., solid concentration 20%), 225 parts by weight 3. Evaluation of Properties of Produced Recording Medium for Ink Jet Printers Next, with regard to the above recording media for ink jet printers of Examples 1 to 10 and Comparative Examples 1 to 6, the objects for evaluation such as a color patch, an SCID image, or the like were printed on the second ink receiving layer, using an ink jet printer (trade name: PM-700C, produced by Seiko Epson Corporation), and printed images in which all properties are superior were thereby obtained. As an SCID image, high-resolution Standard Color Image Data (N1 portrait image and N3 fruit basket image of ISO/JIS-SCID in accordance with Japanese Industrial Standard X9201-1995) was used. Light resistance (xenon lamp acceleration), light resistance in real environments (sunlight), ink receiving layer strength, glossiness adjusting layer strength, ink absorbability, image moisture resistance, and water resistance, were evaluated by methods described below using these printed images, and these results are shown in Table 2. Additionally, with respect to the non-recorded recording media for ink jet printers, the 60 degree specular glossiness of each glossiness adjusting layer was measured.

Evaluation Methods (1) Light Resistance 1
(Xenon Lamp Accelerated Test)

A magenta color patch was printed on each recording medium for ink jet printers of Examples and Comparative Examples, and these recording media were irradiated by UV radiation at 45 kJ/m$^2$ under the conditions black panel temperature: 63° C.; relative humidity: 50%; emission power of ultraviolet at 340 nm: 0.35 W/m$^2$, using a xenon whether-ometer (trade name: Ci-5000, produced by Atlas Electric Devices Co.). Then, the remaining ratio of refraction density was obtained by measuring the refraction density of the exposed magenta color patch and the original, using a spectrophotometer (trade name: GRETAG SPM50, produced by Gretag Macbeth Corporation), and the light resistance 1 was evaluated according the following criteria.

Remaining Ratio of Refraction Density

- A: cases where the refraction density of the exposed magenta color patch is more than 90% of the original refraction density
- B: cases where the refraction density of the exposed magenta color patch is 80 to 90% of the original refraction density
- C: cases where the refraction density of the exposed magenta color patch is less than 80% of the original refraction density (2) Light Resistance 2
(Sunlight and Real Environment Test)

Yellow, magenta, cyan, and black color patches were printed on each recording medium for ink jet printers for the Examples and Comparative Examples, and these recording media were left near a window facing south for about 1 month. Thereafter, the remaining ratios of the refraction density were obtained on these color patches, in the same manner as light resistance 1, and the light resistance 2 was evaluated by the average of the remaining ratios.

Remaining Ratio of Refraction Density

A: cases where the refraction density of the test color patch is more than 90% of the original refraction density B: cases where the refraction density of the test color patch is 80 to 90% of the original refraction density C: cases where the refraction density of the test color patch is less than 80% of the original refraction density (3) Ink Receiving Layer Strength (Adhesive Property)

With respect to the recording media for ink jet printers for Examples 1 to 5 and Comparative Examples 1 to 3, a piece of cellophane tape was adhered on the first ink receiving layer formed images and was pulled off, whereby the ink receiving layer strength was evaluated according to the following criteria.

Evaluation of Ink Receiving Layer Strength

A: cases where no problem at all was observed in practice and the ink receiving layer strength was superior (nothing adhered to the cellophane tape)

B: cases where no problem was observed in practice and the ink receiving layer strength was superior (a few fragments adhered to the cellophane tape, but no part of the recorded image tore off)

C: cases where ink receiving layer strength was inferior in practice (at least a part of the recorded image tore off)

(4) Glossiness Adjusting Layer Strength (Adhesive Property)

With respect to the recording media for ink jet printers for Examples 6 to 10 and Comparative Examples 4 to 6, a piece of cellophane tape was adhered on the glossiness adjusting layer formed images and was pulled off, whereby the glossiness adjusting layer strength was evaluated according to the following criteria.

Evaluation of Glossiness Adjusting Layer Strength

A: cases where no problem at all was observed in practice and the glossiness adjusting layer strength was superior (nothing adhered to the cellophane tape)

B: cases where no problem was observed in practice and the glossiness adjusting layer strength was superior (a few fragments adhered to the cellophane tape, but no part of the recorded image tore off)

C: cases where glossiness adjusting layer strength was inferior in practice (at least a part of the recorded image tore off)

(5) Ink Absorbability

With respect to SCID images printed on each recording medium for ink jet printers for Examples and Comparative Examples by an ink jet printer, multicolor bleeding and unicolor bleeding thereon were observed, and the ink absorbability was evaluated by comparing the ink absorbabilities of genuine glossy papers (trade name: glossy paper for super-fine (thick-type) photoprint paper, produced by Seiko Epson Corporation) by visual inspection.

Evaluation of Ink Absorbability

A: cases where the multicolor bleeding and unicolor bleeding were not observed, no problem at all was observed in practice, and ink absorbability was superior (equal to or better)

B: cases where the multicolor bleeding and unicolor bleeding were slightly observed, no problem was observed in practice, and ink absorbability was superior C: cases where multicolor bleeding and unicolor bleeding were clearly observed, and ink absorbability was inferior in practice (6) Image Moisture Resistance Yellow, magenta, cyan, red, green, blue, and black color patches were printed on each recording medium for ink jet printers for Examples and Comparative Examples, and these recording media were left under a high humidity condition (temperature: 40° C., humidity: 85%) for 3 days and nights. The image moisture resistance was evaluated by observing color change and bleeding outline of color patches.

Evaluation of Image Moisture Resistance

A: cases where no problem at all was observed in practice and image moisture resistance was superior (color change and bleeding outline was not observed at all)

B: cases where no problem was observed in practice and image moisture resistance was superior (slight bleeding was observed)

C: cases where image moisture resistance was inferior in practice (7) Water Resistance Yellow, magenta, cyan, red, green, blue, and black letters were printed on each recording medium for ink jet printers for Examples and Comparative Examples, and the recording media had one drop of water placed thereon by a syringe, and they were air-dried. The water resistance was evaluated according the following criteria.

Evaluation of Water Resistance

A: cases where the dyes of all colors did not flow

B: cases where the dye of at least one color flowed, but letters were still legible C: cases where letters were not legible

TABLE 2

| | Acrylic copolymer solution used | | Light | Light | Layer strength (adhesive property) | | Ink | Image | Water | |
|---|---|---|---|---|---|---|---|---|---|---|
| | Ink receiving layer | Glossiness Adjusting layer | resistance 1 | resistance 2 | Ink receiving layer | Glossiness Adjusting layer | absorb-ability | moisture resistance | resist-ance | Glossi-ness |
| Example 1 | Copolymer 1 | | A | A | A | — | A | A | A | 50 |
| Example 2 | Copolymer 2 | | A | A | A | — | A | A | A | 48 |
| Example 3 | Copolymer 3 | | A | A | A | — | A | A | A | 43 |

TABLE 2-continued

| | Acrylic copolymer solution used | | Light | Light | Layer strength (adhesive property) | | Ink | Image | Water | |
|---|---|---|---|---|---|---|---|---|---|---|
| | Ink receiving layer | Glossiness Adjusting layer | resistance 1 | resistance 2 | Ink receiving layer | Glossiness Adjusting layer | absorb-ability | moisture resistance | resist-ance | Glossi-ness |
| Example 4 | Copolymer 4 | | A | A | A | — | A | A | A | 45 |
| Example 5 | Copolymer 5 | | A | A | A | — | A | A | A | 48 |
| Example 6 | | Copolymer 1 | A | A | — | A | A | A | A | 61 |
| Example 7 | | Copolymer 2 | A | A | — | A | A | A | A | 58 |
| Example 8 | | Copolymer 3 | A | A | — | A | A | A | A | 58 |
| Example 9 | | Copolymer 4 | A | A | — | A | A | A | A | 62 |
| Example 10 | | Copolymer 5 | A | A | — | A | A | A | A | 60 |
| Comparative Example 1 | Copolymer 6 | | B | B | B | — | A | C | B | 43 |
| Comparative Example 2 | Copolymer 7 | | B | B | B | — | A | C | B | 46 |
| Comparative Example 3 | Copolymer 8 | | B | B | B | — | A | C | B | 45 |
| Comparative Example 4 | | Copolymer 6 | B | B | — | B | A | C | B | 44 |
| Comparative Example 5 | | Copolymer 7 | B | B | — | B | A | C | B | 43 |
| Comparative Example 6 | | Copolymer 8 | B | B | — | B | A | C | B | 47 |

As is apparent from the results in Table 2, the recording media for ink jet printers according to the present invention had superior light resistance, ink receiving layer strength or glossiness adjusting layer strength, ink absorbability, image moisture resistance, and water resistance. In contrast, in the recording media for ink jet printers of the Comparative Examples, light resistance, ink receiving layer strength or glossiness adjusting layer strength, and water resistance were inferior, and in particular, image moisture resistance was extremely inferior so that these recording media for ink jet printers could not be used in practice. In addition, although the recording media for ink jet printers of Examples 6 to 10 carried out a calender processing under the same conditions as in Examples 1 to 5, the glossinesses thereof were higher than those of Examples 1 to 5.

As explained above, according to the present invention, a recording medium for ink jet printers having effects which have heretofore not been obtained, for preventing general light deterioration of recorded images such as lowering of image clarity, decrease in density, changing in color tone, etc., can be provided by including acrylic copolymer in which (meth)acrylate having a solubility parameter (δ) of 15.0 to 23.0 $MPa^{1/2}$ is a copolymerizing component, in an ink receiving layer or at least one of two or more ink receiving layers coated on a base material.

What is claimed is:

1. A recording medium for ink jet printers comprising an ink receiving layer provided on a base material, wherein the ink receiving layer contains acrylic copolymer in which at least (meth)acrylate having a solubility parameter (δ) of 15.0 to 23.0 $MPa^{1/2}$ is a copolymerizing component and an ester group in the (meth)acrylate is a cycloalkyl group, and the acrylic copolymer consists of at least four copolymerizing components of an (a) component: (meth)acrylate having a solubility parameter (δ) of 15.0 to 23.0 $MPa^{1/2}$, a (b) component: dialkylaminoalkyl (meth)acrylate, and a (c) component: acrylamide, and a (d) component: alkoxy polyethylene glycol (meth)acrylate.

2. A recording medium for ink jet printers according to claim 1, wherein the acrylic copolymer consists of at least five copolymerizing components in which an (e) component 2-hydroxyalkyl (meth)acrylate is further contained.

3. A recording medium for ink jet printers according to claim 1, wherein a copolymerization ratio of the copolymerizing components in the acrylic copolymer is (a) component of 5 to 25% by weight, (b) component of 30 to 60% by weight, (c) component of 2 to 7% by weight, and (d) component of 5 to 65% by weight.

4. A recording medium for ink jet printers according to claim 2, wherein a copolymerization ratio of the copolymerizing components in the acrylic copolymer is (a) component of 5 to 25% by weight, (b) component of 30 to 60% by weight, (c) component of 2 to 7% by weight, (d) component of 5 to 65% by weight, and (e) component of 0 to 55% by weight.

5. A recording medium for ink jet printers according to claim 1, wherein the (b) component is at least one selected from dimethylaminoethyl (meth)acrylate and diethylaminoethyl (meth)acrylate.

6. A recording medium for ink jet printers according to claim 2, wherein the (b) component is at least one selected from dimethylaminoethyl (meth)acrylate and diethylaminoethyl (meth)acrylate.

7. A recording medium for ink jet printers according to claim 1, wherein the (d) component is at least one selected from methoxy polyethylene glycol (meth)acrylate, ethoxy polyethylene glycol (meth)acrylate, and propoxy polyethylene glycol (meth)acrylate.

8. A recording medium for ink jet printers according to claim 2, wherein the (d) component is at least one selected from methoxy polyethylene glycol (meth)acrylate, ethoxy polyethylene glycol (meth)acrylate, and propoxy polyethylene glycol (meth)acrylate.

* * * * *

UNITED STATES PATENT AND TRADEMARK OFFICE

CERTIFICATE OF CORRECTION

PATENT NO. : 6,656,544 B1
DATED : December 2, 2003
INVENTOR(S) : Takayuki Ishikawa et al.

It is certified that error appears in the above-identified patent and that said Letters Patent is hereby corrected as shown below:

Title page,
Item [73], Assignee, please correct the first Assignee's name and add a second Assignee's name and address as follows:

-- Tomoegawa Paper Co., Ltd., Tokyo (JP);
Seiko Epson Corporation, Tokyo (JP) --.

Signed and Sealed this

Twenty-sixth Day of October, 2004

JON W. DUDAS
*Director of the United States Patent and Trademark Office*